US009368910B2

(12) United States Patent
Eichorn et al.

(10) Patent No.: US 9,368,910 B2
(45) Date of Patent: Jun. 14, 2016

(54) ELECTRICAL CONNECTOR WITH MECHANICALLY ASSISTED ENGAGEMENT

(71) Applicant: DELPHI TECHNOLOGIES, INC., Troy, MI (US)

(72) Inventors: Daniel S. Eichorn, Rochester Hills, MI (US); Andrew Joseph Jozwiak, El Paso, TX (US); Grant Michael Wheeler, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/470,016

(22) Filed: Aug. 27, 2014

(65) Prior Publication Data

US 2016/0064856 A1 Mar. 3, 2016

(51) Int. Cl.
*H01R 13/62* (2006.01)
*H01R 13/629* (2006.01)

(52) U.S. Cl.
CPC .... *H01R 13/62933* (2013.01); *H01R 13/62977* (2013.01)

(58) Field of Classification Search
CPC ..... H01R 13/193; H01R 23/684; H01R 12/7058; H01R 12/82; H01R 12/89; H01R 13/62933; H01R 13/62977; H01R 13/62983; H01R 13/62938
USPC ..... 439/259, 266, 347, 157, 299, 372
See application file for complete search history.

(56) References Cited

U.S. PATENT DOCUMENTS

| | | | | |
|---|---|---|---|---|
| 5,715,135 | A | 2/1998 | Brussalis et al. | |
| 5,788,529 | A | 8/1998 | Borzi et al. | |
| 6,019,620 | A | 2/2000 | Kodama et al. | |
| 6,065,982 | A | 5/2000 | Okabe | |
| 6,183,279 | B1 * | 2/2001 | Murakami et al. | 439/157 |
| 6,305,957 | B1 | 10/2001 | Fink et al. | |
| 6,382,992 | B1 * | 5/2002 | Bouchan et al. | 439/157 |
| 6,702,597 | B2 * | 3/2004 | Pade | 439/157 |
| 6,739,889 | B1 | 5/2004 | Daggett et al. | |
| 6,824,406 | B1 * | 11/2004 | Sharples et al. | 439/157 |
| 6,890,194 | B2 * | 5/2005 | Katsuma | 439/157 |
| 6,971,894 | B2 * | 12/2005 | Dillon et al. | 439/157 |
| 7,094,081 | B1 | 8/2006 | Senk et al. | |
| 7,445,491 | B2 | 11/2008 | Fujii et al. | |
| 2013/0337671 | A1 | 12/2013 | Tsang et al. | |
| 2014/0134862 | A1 * | 5/2014 | Itou | H01R 13/62944 439/157 |

FOREIGN PATENT DOCUMENTS

| | | | |
|---|---|---|---|
| WO | 96/32761 | A1 | 10/1996 |
| WO | 2014046877 | A1 | 3/2014 |

* cited by examiner

*Primary Examiner* — Neil Abrams
*Assistant Examiner* — Travis Chambers
(74) *Attorney, Agent, or Firm* — Robert J. Myers

(57) ABSTRACT

A mechanically assisted electrical connector including a lever and a slider. The slider is coupled to the lever such that movement of the lever moves the slider. The slider defines a slot that is configured to cooperate with a post of a mating connector in a manner effective to urge the electrical connector and the mating connector together when the lever is moved from a first position to a second position. A ramp angle of the slot is varied to reduce a peak value of an applied force to advance the lever from the first position to the second position when connecting the electrical connector to the mating connector.

4 Claims, 7 Drawing Sheets

ELECTRICAL CONNECTOR WITH MECHANICALLY ASSISTED ENGAGEMENT

TECHNICAL FIELD OF THE INVENTION

This invention generally relates to an electrical connector, and more particularly relates to an electrical connector with mechanically assisted engagement.

BACKGROUND OF THE INVENTION

Mechanically assisted electrical connectors typically include features that provide a mechanical advantage to an assembler to reduce the force to make an electrical connection with a mating connector. Known designs that utilize a lever to actuate a slider that has a linear (i.e. straight) ramp that interact with pins or posts to pull two connectors together are shown in U.S. Pat. No. 6,305,957 and International Patent Publication WO2014046877, hereby incorporated herein by reference. A shortcoming of these connector designs is the need for the person operating the lever to provide additional force to compensate for variation in the effective length of the lever and in the engagement force generated by the electrical connector and mating connector as the lever is being advanced and the connection is being made.

BRIEF SUMMARY OF THE INVENTION

In accordance with one embodiment, an electrical connector is provided. The electrical connector includes a lever moveably coupled to the electrical connector and moveable from a first position to a second position and a slider that is slideably coupled to the electrical connector and coupled to the lever such that rotational movement of the lever from the first position to the second position moves the slider laterally. The slider defines a slot having a ramp between a slot opening portion and a slot end portion. The ramp is configured to engage a post of a mating connector in a manner effective to urge the electrical connector and the mating connector together when the lever is moved from the first position to the second position. A ramp angle is varied along a length of the ramp to reduce a peak value of an applied force to advance the lever from the first position to the second position when connecting the electrical connector to the mating connector.

The ramp angle may be varied in accordance with a mechanical advantage of the lever to move the slider. The ramp angle may be varied in accordance with an engagement force generated by the electrical connector and the mating connector when the electrical connector and the mating connector are urged together. The ramp angle may be further varied in accordance with a mechanical advantage of the lever to move the slider.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF DESCRIPTION OF THE SEVERAL VIEWS OF THE DRAWING

The present invention will now be described, by way of example with reference to the accompanying drawings, in which.

Figure 1:
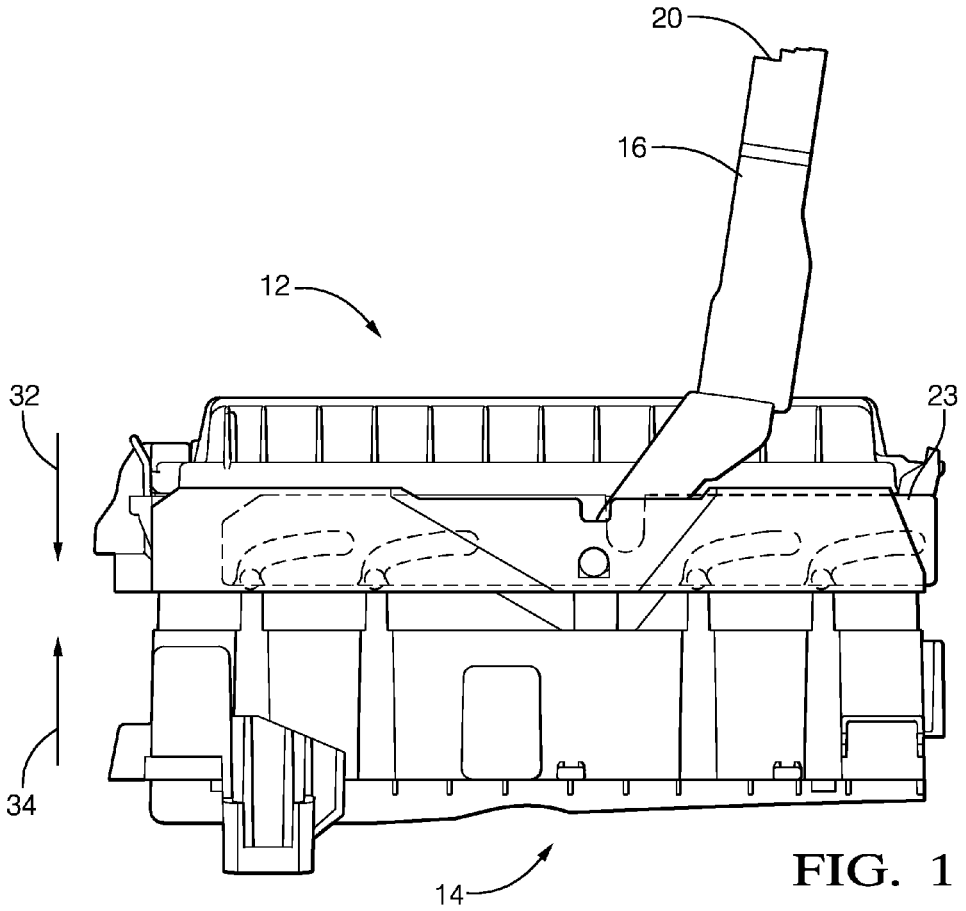
FIG. 1 is an isometric view of an electrical connector and a mating connector in accordance with one embodiment.
Figure 2:
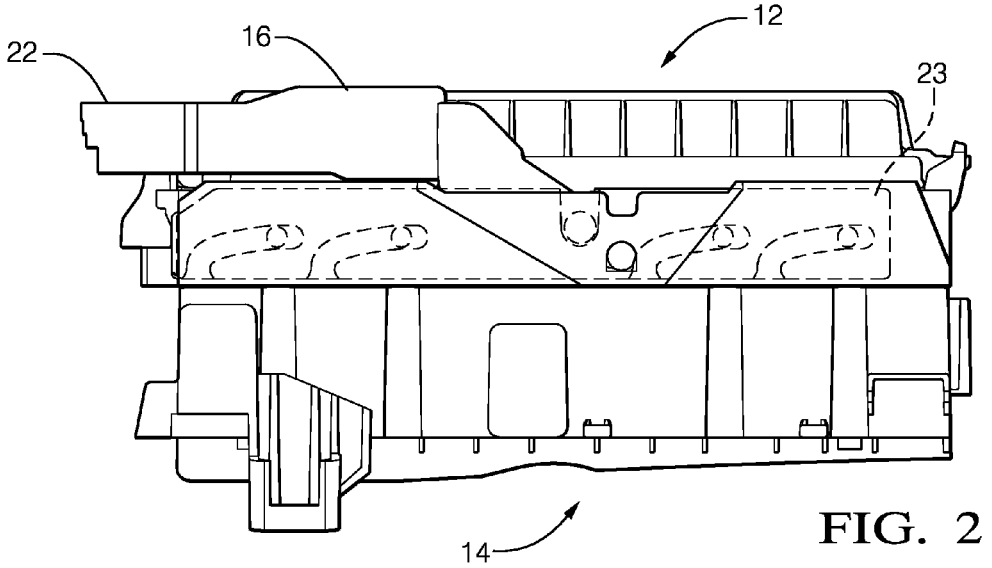
FIG. 2 is a side view of the electrical connector and the mating connector of FIG. 1 when a lever of the electrical connector in a first position in accordance with one embodiment.
Figure 3:
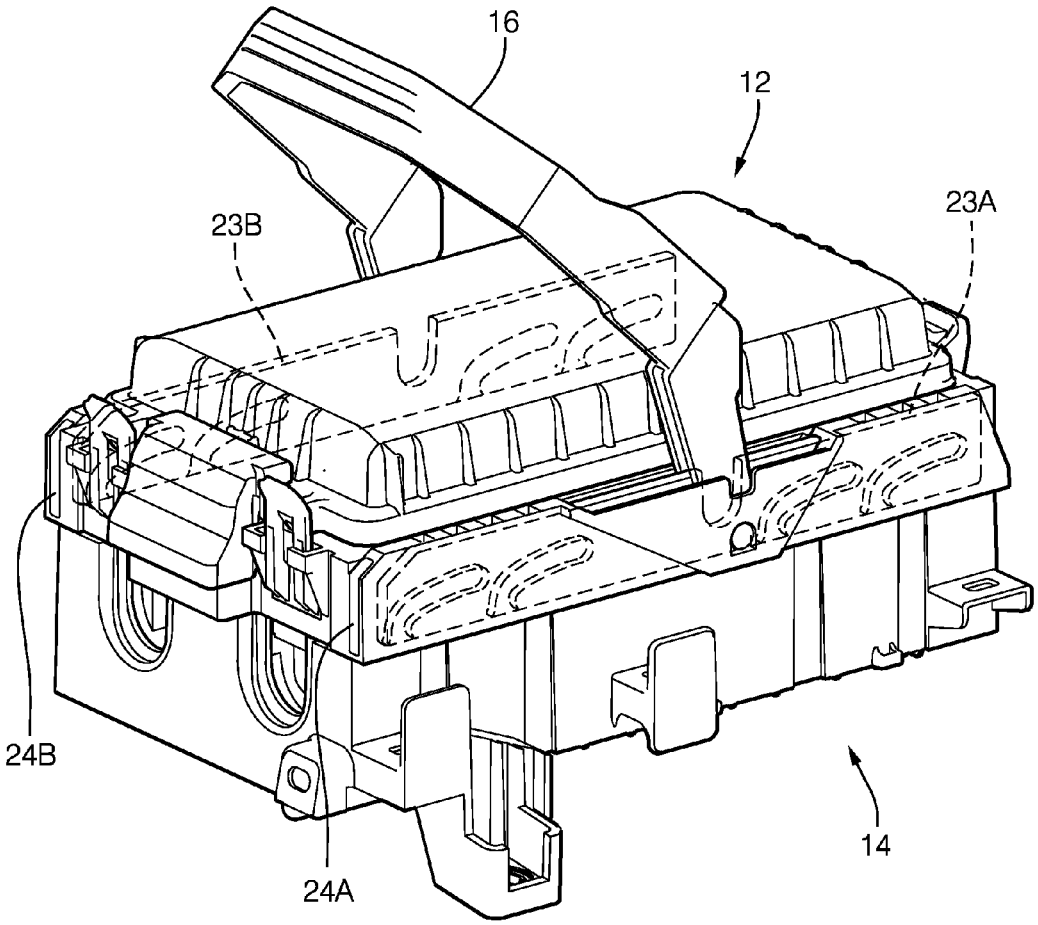
FIG. 3 is a side view of the electrical connector and the mating connector of FIG. 1 when the lever of the electrical connector in a second position in accordance with one embodiment.
Figure 4:
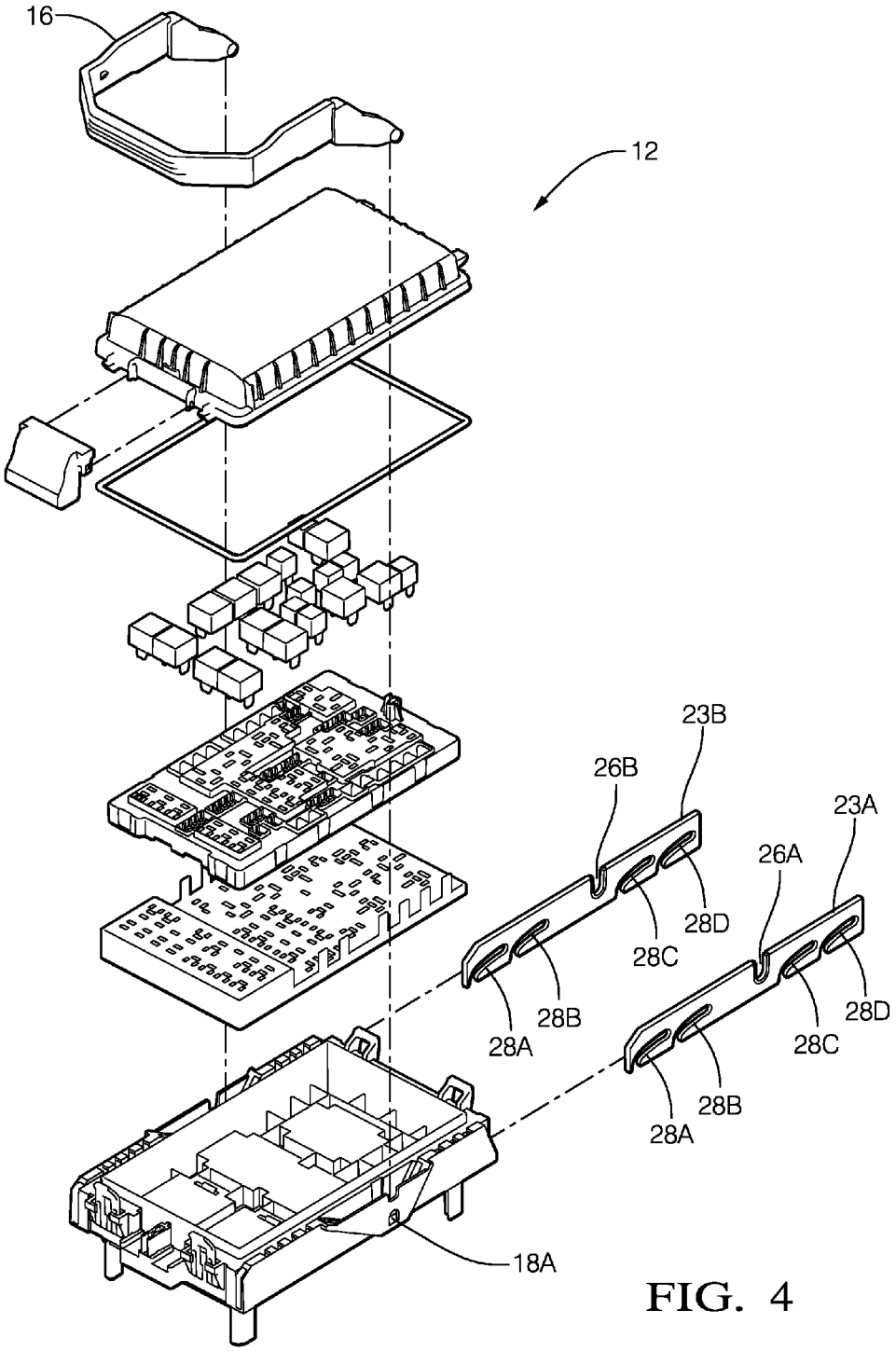
FIG. 4 is an exploded view of the electrical connector of FIG. 1 with an unexploded view of the mating connector of FIG. 1 in accordance with one embodiment.

Further features and advantages of the invention will appear more clearly on a reading of the following detailed description of the preferred embodiment of the invention, which is given by way of non-limiting example only and with reference to the accompanying drawings.

DETAILED DESCRIPTION OF THE INVENTION

FIGS. 1-4 illustrate a non-limiting example of a mechanically assisted electrical connector 12 configured to connect with a corresponding mating connector 14. The electrical connector 12 includes a lever 16 to provide a mechanical advantage when connecting the electrical connector 12 to the mating connector 14. In general, the lever 16 is moveably coupled to the electrical connector 12 via circular notches 18A and 18B, and is moveable from a first position 20 to a second position 22. In this example, the first position 20 and second position 22 may be alternatively characterized as an initial position 20 and a final position 22, respectively. The electrical connector 12 includes a slider 23 that in this example consists of a first slider 23A and a second slider 23B. Those knowledgeable in the art will appreciate that the slider 23 could alternatively be made of a single piece and can be referred to in a singular manner. The sliders 23A, 23B are slideably coupled to the electrical connector 12 via cavities 24A and 24B, respectively. The sliders 23A, 23B are coupled to the lever 16 via elongated notches 26A and 26B, respectively, such that a rotational movement of the lever 16 moves the sliders 23A, 23B laterally.

Figure 5:
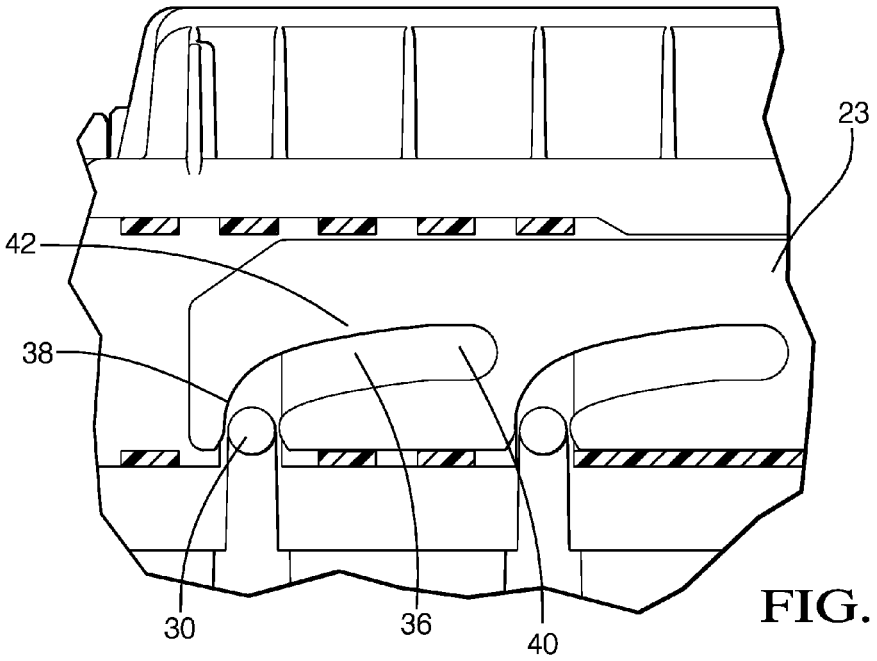
FIG. 5 is a close-up side view of a slot in a slider of the electrical connector of FIG. 1 in accordance with one embodiment.

Each of the sliders 23A, 23B of the electrical connector 12 defines at least one slot 28. The slot 28 is configured to cooperate with a post 30 of the mating connector 14 in a manner effective to urge the electrical connector 12 and mating connector 14 together when the lever 16 is moved from the first position 20 to the second position 22. Slots 28A, 28B, 28C, 28D, 28E, 28F, and 28G of the slider 23 are all configured similarly to slot 28. The slots 28A-G cooperate with posts 30A, 30B, 30C, 30D, 30E, 30F, 30G of the mating connector 14, respectively, in manner similar to that of the slot 28 with the post 30. The slot 28 distributes a connection force 32 needed to overcome an engagement force 34 generated by the electrical connector 12 and the mating connector 14 when the electrical connector 12 and mating connector 14 are urged together. The slot 28 has a ramped portion between a slot opening portion 38 and a slot end portion 40, as shown in FIG. 5. The slot opening 38 and the slot end portions 40 each have a transition portion 38A and 40A respectively that is shaped to interface the slot opening 38 and the slot end portions 40 to the ramped portion 36. The ramped portion 36, hereinafter referred to as the ramp 36, is configured to urge the electrical connector 12 and mating connector 14 together when the slot 28 interacts with the post 30.

The ramp 36 is characterized as having a ramp angle 42 that may be described as the slope of the ramp 36 tangent to the point where the post 30 contacts the ramp 36.

This ramp angle 42 varies along the length of the ramp 36, i.e. the ramp 36 is curved so the slope of the ramp 36 is not constant as it would be if the ramp 36 were linear. The ramp angle 42 is selected so that the interface of the post 30 with the ramp 36 reduces a peak value of an applied force 44 and/or a variation of the applied force 44 to advance the lever 16 from the first position 20 to the second position 22 when connecting the electrical connector 12 to the mating connector 14. The ramp angle 42 is varied to compensate for variation in other variables that affect the peak applied force 44 and variation of the applied force 44. The ramp angle 42 may be selected so that curve of the ramp 36 has a non-constant radius.

Figure 6:
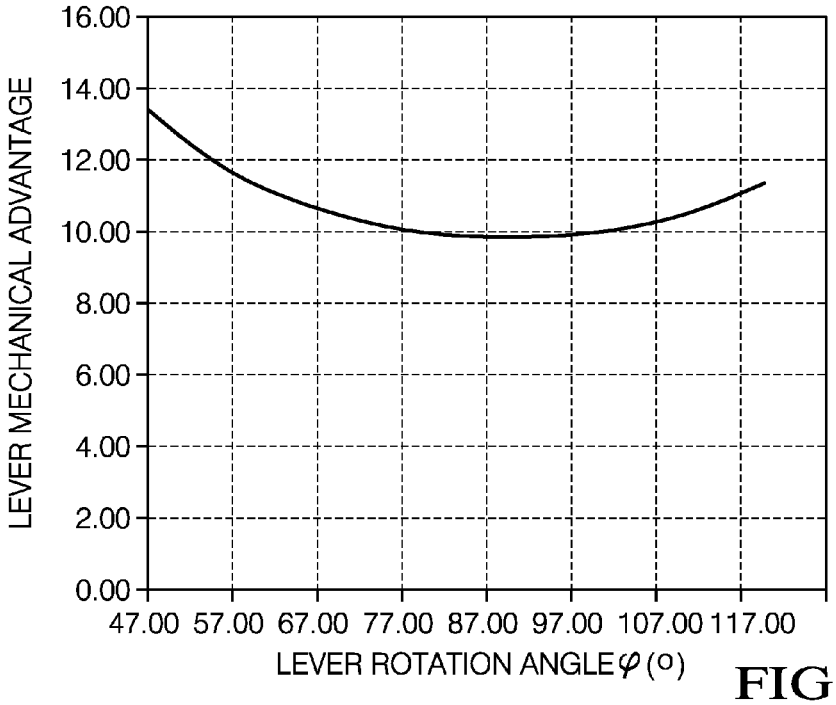
FIG. 6 is a graph of a mechanical advantage being provided by the lever as the lever is moved from the first position to the second position in accordance with one embodiment.
Figure 7:
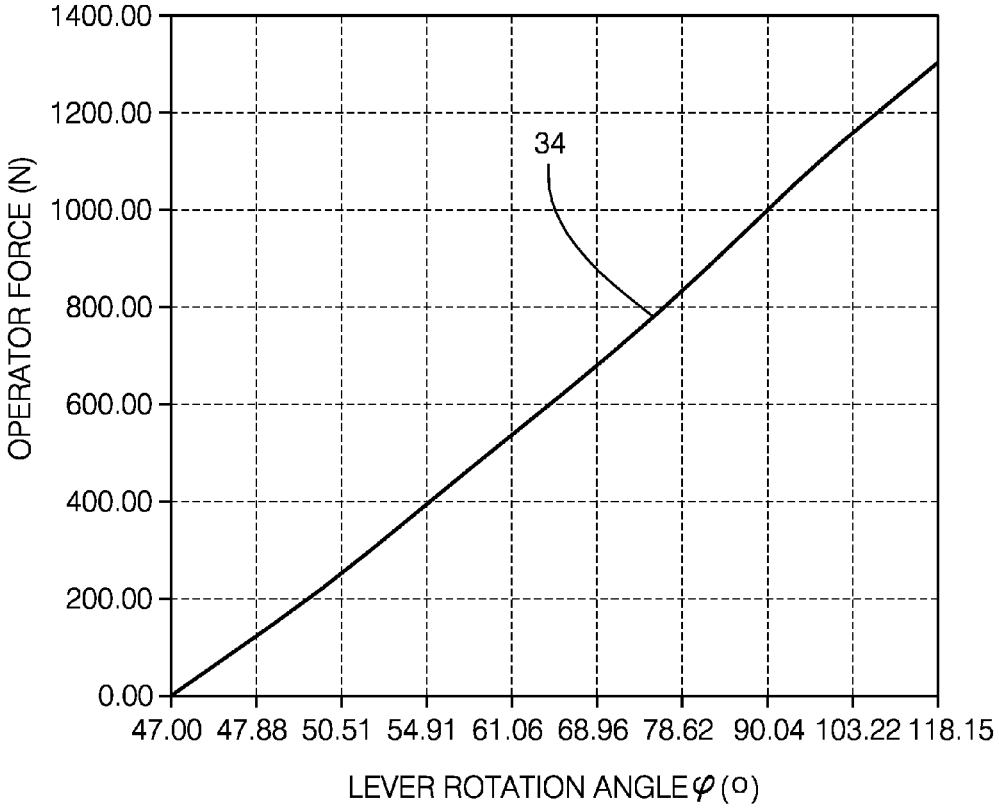
FIG. 7 is a graph of an engagement force generated by the electrical connector and the mating connector as the lever is moved from the first position to the second position in accordance with one embodiment.

In the example shown, the ramp angle 42 is varied along the length of the ramp 36 in accordance with the mechanical advantage of the lever 16 to move the slider 23 (FIG. 6) and the engagement force 34 (FIG. 7).

The engagement force 34 may be estimated by determining the total engage force of all of the mating terminals $F_T$ This terminal engagement force may be reduced 30 to 70% by the use of a terminal lubricant. This engagement force reduction may be represented by a lubrication factor $L_T$. Misalignment between the mating terminals may increase the engagement force 34 between 30 and 40%. This engagement force increase may be represented by a misalignment factor $M_S$. The engagement force 34 may also be affected by additional forces needed to mate the connectors such as the forces needed to compress seals and/or grommets, represented by $F_{other}$. Therefore the engagement force 34 may be calculated by the formula:

$$F_{engage}=F_T M_S L_T+F_{other}$$

Figure 8:
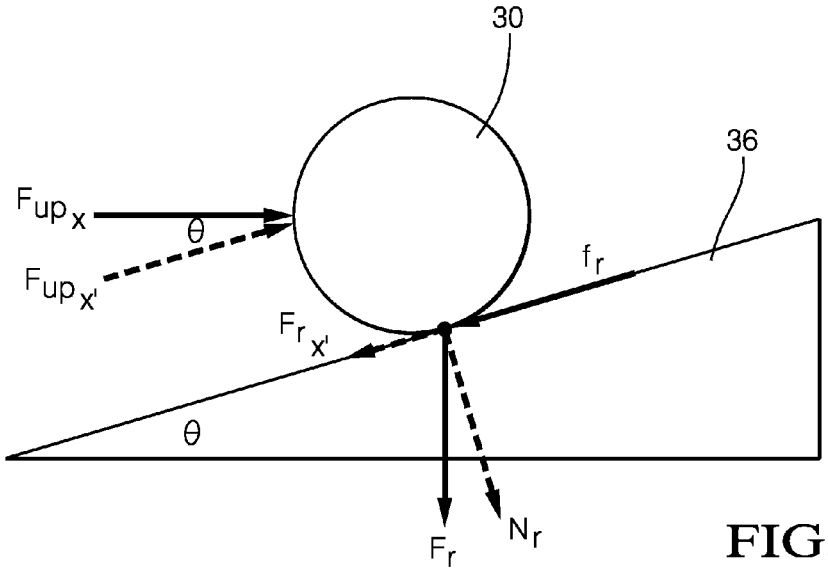
FIG. 8 is a free body diagram of the ramp and post of the electrical connector of FIG. 1 in accordance with one embodiment.

FIG. 8 illustrates a free body diagram of the post 30 and the ramp 36. For a 'classic' analysis, treat the post 30 as a body with weight of magnitude $F_r$ with a force of magnitude $F_{up}$ parallel to and directed up the ramp 36 where:

$$F_r = \frac{\frac{1}{2}F_{engage} \pm f_p}{n_r}$$

$n_r$ is the total number of ramps per slide. $f_p$ and $F_r$ will be discussed in more detail below. The ramp angle 42, θ, can be used to break $F_r$ into component forces perpendicular and parallel to the ramp 36 such that the normal force, $N_r=F_r \cos\theta$ a component of $F_r$ sliding down the ramp 36, $F_{r_{x'}}=F_r \sin\theta$ Friction between the post 30 and ramp 36, $f_r=N_r\mu_r$. The coefficient of friction, $\mu_r$, between the ramp 36 and the post 30 which is dependent on the selected materials. If $\mu_r$ is unknown a conservative value of 0.27 can be used Summing the forces parallel to the ramp 36:

$$\Sigma F_{x'}=0=F_{up_{x'}}-F_{r_{x'}}-f_r$$

In reality a horizontal force, $F_{up_{x'}}$ is being applied to the ramp 36 by the motion of the slider 23 such that $F_{up}$ can be treated as a component of $F_{up_{x'}}$:

$$\begin{aligned}
F_{up_x} &= \frac{F_{up_{x'}}}{\cos\theta} = \frac{F_{r_{x'}} + f_r}{\cos\theta} = \frac{F_r\sin\theta + N_r\mu_r}{\cos\theta} \\
&= \frac{\left(\frac{\frac{1}{2}F_{engage} \pm F_{SP}\mu_p}{n_r}\right)\sin\theta + \left(\frac{\frac{1}{2}F_{engage} \pm F_{SP}\mu_p}{n_r}\right)\cos\theta\mu_r}{\cos\theta} \\
&= \left(\frac{\frac{1}{2}F_{engage} \pm F_{SP}\mu_p}{n_r}\right)\left(\frac{\sin\theta + \cos\theta\mu_r}{\cos\theta}\right) \\
&= \left(\frac{\frac{1}{2}F_{engage} \pm F_{SP}\mu_p}{n_r}\right)(\tan\theta + \mu_r)
\end{aligned}$$

Figure 9:
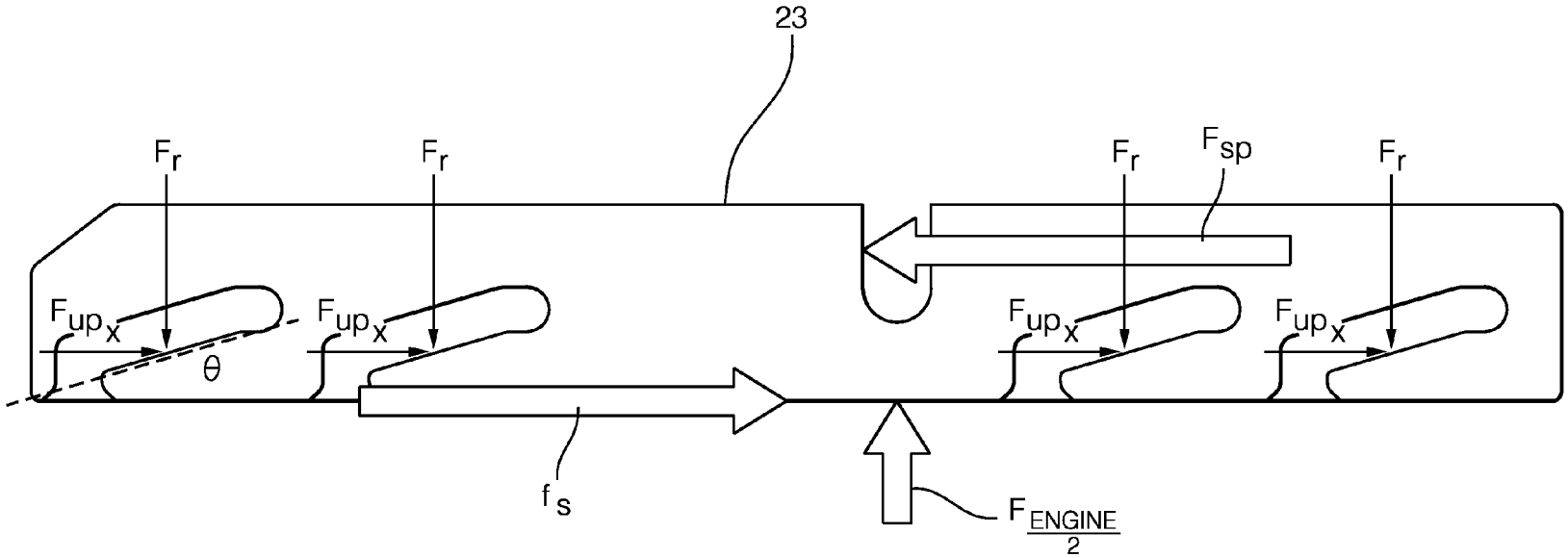
FIG. 9 is a diagram of forces acting on the slider of the electrical connector of FIG. 1 in accordance with one embodiment.

FIG. 9 illustrates a free body diagram of the slide. The motion of the slide post 30 against the slider 23 creates a force, $f_p$, due to friction $$f_p=F_{SP}\mu_p$$

The motion of the slider 23 will be opposed by the force of friction, $f_s$, between the bottom of the slider 23 and the housing $$f_s = \left(\frac{1}{2}F_{engage} \pm f_p\right)\mu_s$$

The coefficients of friction, $\mu_s$ (the coefficient of friction between the housing and slider 23) and $\mu_p$ (the coefficient of friction between the slide post 30 and slider 23), are functions of the selected materials. If $\mu_s$ and $\mu_p$ are unknown a conservative value of 0.27 can be used.

Summing the forces in x:

$$\sum F_x = 0 = -F_{SP} + n_r F_{up_x} + f_s;$$

$$F_{SP} =$$

$$n_r F_{up_x} + f_s = n_r\left(\frac{\frac{1}{2}F_{engage} \pm F_{SP}\mu_p}{n_r}\right)(\tan\theta + \mu_r) + \left(\frac{1}{2}F_{engage} \pm f_p\right)\mu_s =$$

$$\left(\frac{1}{2}F_{engage} \pm F_{SP}\mu_p\right)(\tan\theta + \mu_r + \mu_s)$$

Solving for $F_{SP}$:

$$F_{SP} = \mp \frac{(\tan\theta + \mu_r + \mu_s)F_{engage}}{2\mu_p\mu_s + 2\mu_p\tan\theta + 2\mu_p\mu_r \mp 2}$$

Summing forces in y:

$$\text{From } \varphi_i \text{ to } \varphi = 90°, \sum F_y = 0 = \frac{1}{2}F_{engage} - F_r n_r + f_p;$$

$$\text{Therefore, } F_r = \frac{\frac{1}{2}F_{engage} + F_{SP}\mu_p}{n_r}$$

$$\text{From } \varphi = 90° \text{ to } \varphi_f, \sum F_y = 0 = \frac{1}{2}F_{engage} - F_r n_r - f_p;$$

$$\text{Therefore, } F_r = \frac{\frac{1}{2}F_{engage} - F_{SP}\mu_p}{n_r}$$

There is friction between the slide post 30 and slider 23 such that:

from $\phi_i$ to $\phi$=90° the lever 16 applies an upward force on the slider 23; and from $\phi$=90° to $\phi_f$ the lever 16 applies a downward force on the slider 23.

The mechanical advantage for the slider 23 may be calculated:

$$F_{SP} = \mp \frac{(\tan\theta + \mu_r + \mu_s)F_{engage}}{2\mu_p\mu_s + 2\mu_p\tan\theta + 2\mu_p\mu_r \mp 2}$$

$$\text{When } u_r = 0,\ F_{SP'} = \mp \frac{(\tan\theta + \mu_r)F_{engage}}{2\mu_p\tan\theta + 2\mu_p\mu_r \mp 2}$$

$$MA = \frac{F_{SP'}}{F_{SP}} = \frac{(\tan\theta + \mu_r)}{(\tan\theta + \mu_r + \mu_s)} \frac{\left(\mu_s + \tan\theta + \mu_r \mp \frac{1}{\mu_p}\right)}{\left(\tan\theta + \mu_r \mp \frac{1}{\mu_p}\right)}$$

The slider 23 actually has negative impact on mechanical advantage due to friction.

Figure 10:
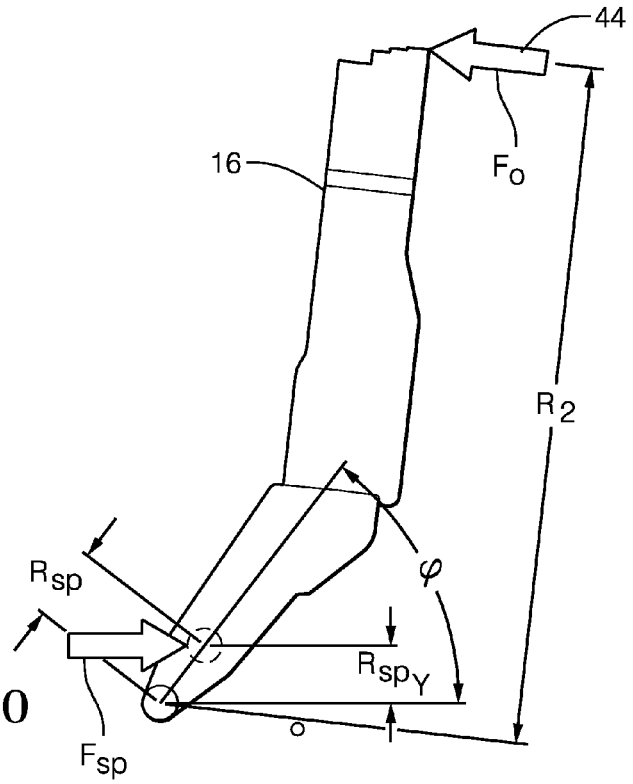
FIG. 10 is a free body diagram of the lever of the electrical connector of FIG. 1 in accordance with one embodiment.

The mechanical advantage of the lever 16 may be understood with reference to FIG. 10. By examining the free body diagram of FIG. 10, the following observations may be made:

The operator applied force 44 ($F_O$) is assumed to be applied perpendicularly to the lever 16 radius $R_2$. The applied force 44 is determined by the ergonomic requirements imposed by the operator. The force $F_{SP}$ of the slider 23 against the slide post 30 acts horizontally. The slide post radius $R_{SP}$ and initial and final angles $\phi_i$ and $\phi_f$ respectively, of the lever 16 are also shown. The vertical component of the slide post radius $R_{SP_y}=R_{SP}\sin\phi$ and the horizontal component of the slide post radius $R_{SP_x}=R_{SP}\cos\phi$. Note that $R_{SP_y}$ and $R_{SP_x}$ vary as the lever 16 moves between the initial position 20 ($\phi_i$) and the final position 22 ($\phi_f$). As $R_{SP_y}$ varies, so that both the applied force 44 ($F_O$) and the lever's 16 mechanical advantage $M_{lever}$ will vary. Summing the moments about the pivot point shows that:

$$\sum M_{PP} = 0 = F_O R_2 - 2F_{SP}R_{SP_y} - 2f_p R_{SP_x};$$

$$\text{where } f_p = F_{SP}\mu_p \text{ and } F_{SP} = \mp \frac{(\tan\theta + \mu_r + \mu_s)F_{engage}}{2\mu_p\mu_s + 2\mu_p\tan\theta + 2\mu_p\mu_r \mp 2}; \text{ and}$$

-continued $$F_O R_2 = 2F_{SP}R_{SP}\sin\varphi + 2F_{SP}\mu_p R_{SP}\cos\varphi, \text{ therefore}$$

$$F_O = \frac{2F_{SP}R_{SP}}{R_2}(\sin\varphi + \mu_p\cos\varphi).$$

The lever's 16 ideal mechanical advantage $M_{lever}$, assuming there is no friction and that the operator applies the applied force 44 ($F_O$) tangent to the lever radius $R_2$, may be derived as such:

$$F_O = \frac{2F_{SP}R_{SP}}{R_2}(\sin\varphi + \mu_p\cos\varphi);$$

$$F_{SP} = \mp \frac{(\tan\theta + \mu_r + \mu_s)F_{engage}}{2\mu_p\mu_s + 2\mu_p\tan\theta + 2\mu_p\mu_r \mp 2};$$

therefore the ideal mechanical advantage of the lever 16 is $$M_{lever} = \frac{2F_{SP}}{F_O} = \frac{R_2}{R_{SP}(\sin\varphi + \mu_p\cos\varphi)} \text{ or } M_{lever} \cong \frac{R_2}{R_{SP}(\sin\varphi)};$$

The minimum mechanical advantage of the lever $M_{lever}$ occurs when the lever angle $\phi$ is 90° since sin 90°=1, maximizing the denominator.

The total mechanical advantage M of the mechanically assisted electrical connector 12 is a product of both the mechanical advantage of the lever $M_{lever}$ and the mechanical advantage $M_{ramp}$ of the interface of the post 30 and the ramp 36 $M=M_{lever}M_{ramp}$. The total mechanical advantage M is a function of both the lever angle $\phi$ and the ramp angle 42 ($\theta$).

Given that the mechanical advantage of the lever 16 is higher at the lever's initial position 20 ($\phi_i$) and final position 22 ($\phi_f$) and lowest at a 90°, the ramp 36 is designed a with a ramp angle 42 (slope) that is 'steeper' at initial and final points but 'shallower' in the middle. The desired slope produces a curve reminiscent of a trigonometric function such as sine or cosine, hence it can modeled as:

$$\frac{dy}{dx} = A\sin(Bx + C) + D, \text{ where } A, B, C \text{ and } D \text{ are constants}$$

Integrating this equation to find the shape of the ramp 36 itself:

$$y(x) = -\frac{A\cos(Bx + C)}{B} + Dx,$$

essentially the combination of a straight line, Dx, with a trigonometric function.

Initial values for the contacts A, B, C and D are selected as follows: Recognizing that D describes the slope of the line of classical form y=mx+b (m being the slope of the line), D can be approximated as the slope or the basic ramp angle 42. Therefore:

$$D = \frac{h_{ramp}}{l_{ramp}}.$$

At x=0, y=0, therefore $$-\frac{A\cos(C)}{B} = 0.$$

This equation is only satisfied if A=0, B=∞ or cos(C)=0; cos(C)=0 when $$C = \frac{(2n-1)\pi}{2}$$

where n is any integer. As A≠0 and B≠∞, $$C = \frac{\pi}{2}.$$

B affects the frequency or the trigonometric function. Recognizing that the cosine function is applied from 0 to 2π over the length of the ramp 36, $$B = \frac{2\pi}{l_{ramp}}.$$

A affects the amplitude of the trigonometric function. A may be set to an arbitrary value of A=0.1

In reality the engagement force 34 is not constant as different terminals or sets of terminals will engage at different points along the engagement of the mechanically assisted electrical connector 12. During the initial lever throw, the engagement force 34 is very low. Hence, initially, the mechanically assisted electrical connector's 12 high mechanical advantage is not needed and is being 'wasted'. The design can be improved by adjusting the ramp's shape or profile, changing the ramp angle 42 along the length of the ramp 36 to better use the lever's mechanical advantage through its complete throw. This can be done by minimizing the electrical connector's 12 mechanical advantage while the engagement force 34 is low and maximizing the electrical connector's 12 mechanical advantage when the engagement force 34 is at its highest value. The geometry of the lever 16 does not change as the lever 16 is moved from the initial position 20 ($\phi_i$) to the final position 22 ($\phi_f$), therefore it is not possible to make improvements in the lever 16. The slope of the ramp 36 can be designed as a non-linear function of x such that its slope is higher initially and lower when the engagement force 34 reaches its highest value. This suggests a ramp 36 characterized by a curve with the equation $$y = x^n\left(\frac{h_{ramp}}{l^n_{ramp}}\right) \text{ with slope } \frac{dy}{dx} = nx^{n-1}$$

rather than a linear ramp with a constant slope as shown above.

Given the lever 16 and ramp 36 design parameters:

$R_{SP}$—Distance between pivot post and slide post 30

$R_2$—Distance between operator contact point and pivot post $n_r$—Number of ramps per slide $u_r$—Coefficient of friction between the ramp 36 the slide post 30

$u_s$—Coefficient of friction between slider 23 and the cavities 24 in the housing $u_p$—Coefficient of friction between lever post pushing the slider 23 and notch 26 in the slider 23

$l_{ramp}$—Ramp length $h_{ramp}$—Ramp height

θ—Comparable linear ramp angle $\phi_i$—Lever initial position 20 angle $\phi_f$—Lever final position 22 angle ΣFt(y)—Total engagement force of the terminals based on the number of terminals by type, the engage force by type and the location of the terminals along the y axis, where the mechanically assisted electrical connector 12 engages along the y axis.

ΣFo(y)—Total engagement force of seals and/or or grommets based on the location of these elements along the y axis. The design of the ramp 36 may be optimized by following these steps:

1. Develop an equation to describe the engage force as a function of y $$F_{engage}=f(y)=\Sigma Ft(y)LtMs+\Sigma Fo(y); \quad \text{(a)}$$

2. Develop an equation to describe the geometry of the ramp 36 with one or more constants to be optimized such that $$y=f(x) \quad \text{(b)}$$

so that the slope of the ramp 36 is $$\frac{dy}{dx} = \frac{dy}{dx}f(x); \quad \text{(c)}$$

3. Develop an equation to describe relationship between x and the angle of the lever ϕ such that $$x=f(\phi) \quad \text{(d)}$$

4. Analyzing forces acting on the post that pushes the sliders 23A, 23B yields $$F_{SP}=f(\theta) \quad \text{(e)}$$

Understanding the relationship between $$\theta \text{ and } \frac{dy}{dx},$$

equations (a), (b), (c) and (e) can be combined yielding $$F_{SP}=f(x); \quad \text{(f)}$$

5. Analyzing forces acting on the lever 16 produces $$F_O=f(\phi); \quad \text{(g)}$$

6. Substituting (f) into (g) simplifies $F_O$; and

7. Use an iterative approach to optimize minimum $F_{O_{MAX}}$ from $\phi_i$ to $\phi_f$, for instance by adjusting n as shown in the following example in steps a) through h):

a) $F_{engage}$=my+b; where: b=0;

$$m = \frac{F_{engage_{max}}}{h_{ramp}},$$

this example assumes a linear increase in engage force, $h_{ramp}$ could also be described as the required terminal contact overlap.

b)

$$y(x) = x^n * \frac{h_{ramp}}{l_{ramp}^n},$$

in this example n is a variable that can be adjusted to optimize the shape of the ramp 36.

c) $dy/dx=nx^{n-1}$ d) $x(\phi)=R_{SP}(\cos\phi_i-\cos\phi)$, as derived from the lever geometry $$\text{e) } F_{SP} = \mp\frac{(\tan\theta + \mu_r + \mu_s)F_{engage}}{2\mu_p\mu_s + 2\mu_p\tan\theta + 2\mu_p\mu_r \mp 2}$$

$$\text{f) } F_{SP} = \mp\frac{(nx^{n-1} + \mu_r + \mu_s)\frac{F_{engage_{MAX}}}{l_{ramp}^n}x^n}{2\mu_p\mu_s + 2\mu_p nx^{n-1} + 2\mu_p\mu_r \mp 2}$$

$$\text{g) } F_O = \frac{2F_{SP}R_{SP}}{R_2}(\sin\phi + \mu_p\cos\phi), \text{ therefore}$$

$$\text{h) } F_O = \frac{2R_{SP}}{R_2}\left(\mp\frac{(nR_{SP}^{n-1}(\cos\phi_i - \cos\phi)^{n-1} + \mu_r + \mu_s)\frac{F_{engage_{MAX}}}{l_{ramp}^n}R_{SP}^n(\cos\phi_i - \cos\phi)^n}{2\mu_p\mu_s + 2\mu_p nR_{SP}^{n-1}(\cos\phi_i - \cos\theta)^{n-1} + 2\mu_p\mu_r \mp 2}\right)(\sin\phi + \mu_p\cos\phi),$$

where n is iteratively adjusted to optimize minimum $F_{O_{MAX}}$ from $\phi_i$ to $\phi_f$.

Figure 11:
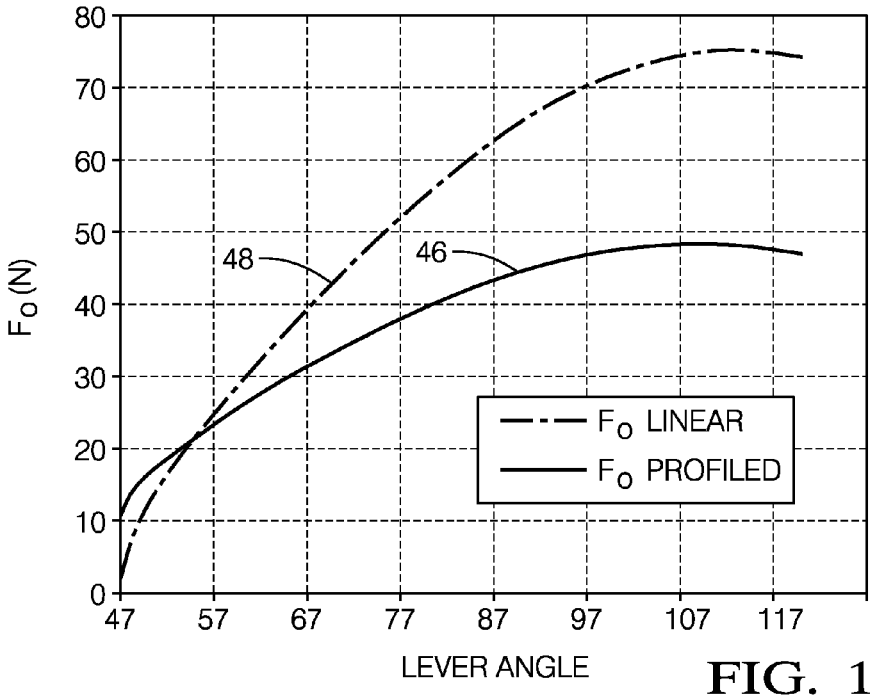
FIG. 11 are graphs of an applied load in relation to a lever position comparing a ramp having a varied ramp angle to a ramp having a constant ramp angle in accordance with one embodiment.

As shown in FIG. 11, the resultant peak value and the variation of the applied force 46 of a ramp 36 having a variable ramp angle 42 is reduced when compared with the resultant peak value and the variation of the applied force 48 of a ramp having a constant ramp angle.

Accordingly, a mechanically assisted electrical connector 12 is provided. The design of the lever 16 and the slots 28 in the slider 23 of the electrical connector 12 reduces the peak value and variation of an applied force 44 to make a connection with a mating connector 14 when compared with the known prior art that utilizes a linear (i.e. straight) ramp.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A electrical connector comprising:

a lever moveably coupled to the electrical connector and moveable from a first position to a second position; and a slider slideably coupled to the electrical connector and coupled to the lever such that rotational movement of the lever from the first position to the second position moves the slider laterally, wherein the slider defines a slot having a ramp having a non-constant radius between a slot opening portion and a slot end portion, said ramp configured to engage a post of a mating connector in a manner effective to urge the electrical connector and the mating connector together when the lever is moved from the first position to the second position, wherein the ramp is curved such that a slope of the ramp is not constant along a length of the ramp and wherein the slope of the ramp is configured to reduce a peak value of an applied force to advance the lever from the first position to the second position when connecting the electrical connector to the mating connector.

2. The electrical connector of claim 1, wherein said slope of the ramp is varied in accordance with the mathematical formula $dy/dx=nx^{n-1}$.

3. The electrical connector of claim 1, wherein said slope of the ramp is varied in accordance with an engagement force generated by the electrical connector and the mating connector when the electrical connector and the mating connector are urged together.

4. The electrical connector of claim 3, wherein said slope of the ramp is further varied in accordance with a mechanical advantage of the lever to move the slider.

* * * * *